United States Patent [19]

Brownell

[11] 4,327,487

[45] May 4, 1982

[54] WOOD CUTTER

[76] Inventor: David A. Brownell, 332 E. Maplehurst, Ferndale, Mich. 48220

[21] Appl. No.: 173,149

[22] Filed: Jul. 28, 1980

[51] Int. Cl.[3] ..... B26B 13/06

[52] U.S. Cl. ..... 30/128; 30/229; 30/258; 145/1 R

[58] Field of Search ..... 30/128, 229, 254, 256, 30/257, 258; 128/318; 145/1 R

[56] References Cited

U.S. PATENT DOCUMENTS

| | | | |
|---|---|---|---|
| 1,686,723 | 10/1928 | Anderson . | |
| 2,028,239 | 1/1936 | Oths . | |
| 2,603,864 | 7/1952 | Neola | 30/229 |
| 2,642,657 | 6/1953 | Arnt | 30/258 X |
| 2,994,321 | 8/1961 | Tischler | 128/318 X |
| 3,014,275 | 12/1961 | Siravo | 30/229 |
| 4,243,047 | 1/1981 | Olsen | 30/128 |

FOREIGN PATENT DOCUMENTS

| | | | |
|---|---|---|---|
| 2455840 | 6/1975 | Fed. Rep. of Germany | 30/258 |

*Primary Examiner*—Jimmy C. Peters

*Attorney, Agent, or Firm*—McGlynn and Milton

[57] ABSTRACT

A cutting tool includes a pair of pivotally connected handles extending through and defining a pair of coacting U-shaped cutting jaws. Each of the cutting jaws defines a cutting edge extending throughout the base and side legs of the U shape. The jaws have a closed position wherein one of the jaws is an inner jaw disposed within the other of the jaws, which is an outer jaw. The cutting edges are angulated in relation to each other so that each of the cutting edges defined by the legs of the respective jaws are not in coacting relationship before the bases of the corresponding jaws. Additionally, the cutting tool includes a knock-out member pivotally disposed within one of the U-shaped jaws for removing material severed by the jaws from the inside thereof.

8 Claims, 5 Drawing Figures

WOOD CUTTER

BACKGROUND OF THE INVENTION

The instant invention relates to cutting tools of the type for removing or severing pieces of material, such as wood, from a larger body. However, the cutting head described herein could be useful in cutting or shaping a variety of other materials.

(1) Field of the Invention

A variety of cutting tools have been developed with specific purposes in mind, for example: cutting heads having two coacting cutting blades mounted to interact have been developed for removing cores from fruit, horns from animals and for various other specific functions. Due to the specific nature of each of these cutting tools, the cutting head of the tool has been constructed specifically for the desired function, i.e., to easily insert it into the fruit for removing the core thereof or for providing a specific cutting edge for cutting an appropriate material.

There is a need for a cutting head of a modified construction for cutting wood. The prior art scissor-like cutting tools include heads which do not have the requisite strength for removing pieces of wood from a solid wood member nor they do they have a cutting edge which grips the wood in such a way that the cutting edge easily cuts through the wood.

The present invention provides a cutting tool having a simple construction which is, therefore, inexpensive to manufacture and includes a cutting head having cutting edges disposed in relation to each other specifically for gripping a piece of wood and easily cutting a piece therefrom, thereby solving the aforementioned problems.

SUMMARY OF THE INVENTION

The instant invention provides a cutting tool including a pair of pivotally connected handles which extend through and define a pair of coacting U-shaped cutting jaws. Each of the jaws defines a cutting edge extending throughout the base and the side legs of the U shape. The jaws have a closed position wherein one of the jaws is an inner jaw disposed within the other of the jaws, which is an outer jaw. The cutting edges are angulated in relation to each other so that the cutting edges defined by the legs of the respective jaws do not coact before the bases of the corresponding U-shaped jaws. Therefore, as the jaws are moved into the closed position, the bases of the U-shaped jaws coact before the legs of the jaws.

PRIOR ART STATEMENT

The U.S. Pat. No. 1,686,723 to Anderson issued Oct. 9, 1928 and the U.S. Pat. No. 2,028,239 to Oths issued Jan. 21, 1936 are examples of prior art cutting tools. The Anderson patent teaches a cutting tool comprising two cutting blades which are curved into two long open-ended loops rivetted together at the widest opening of the loops which is near the handles of the cutting tool. The Oths patent teaches a cutting tool including curved pivotal cutting legs. The cutting legs are chamfered to provide cutting edges adapted to slightly overlap towards each other. Neither the Oths nor the Anderson patent teaches a cutting tool which can effectively remove pieces of wood from a wooden body in that the cutting heads of the respective patents are neither strong enough nor do they have cutting edges which would easily go through a piece of wood. Therefore, these prior art cutting tools do not provide an effective instrument for removing pieces of material from a solid body as does the instant invention.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF PREFERRED EMBODIMENT

Figure 1:
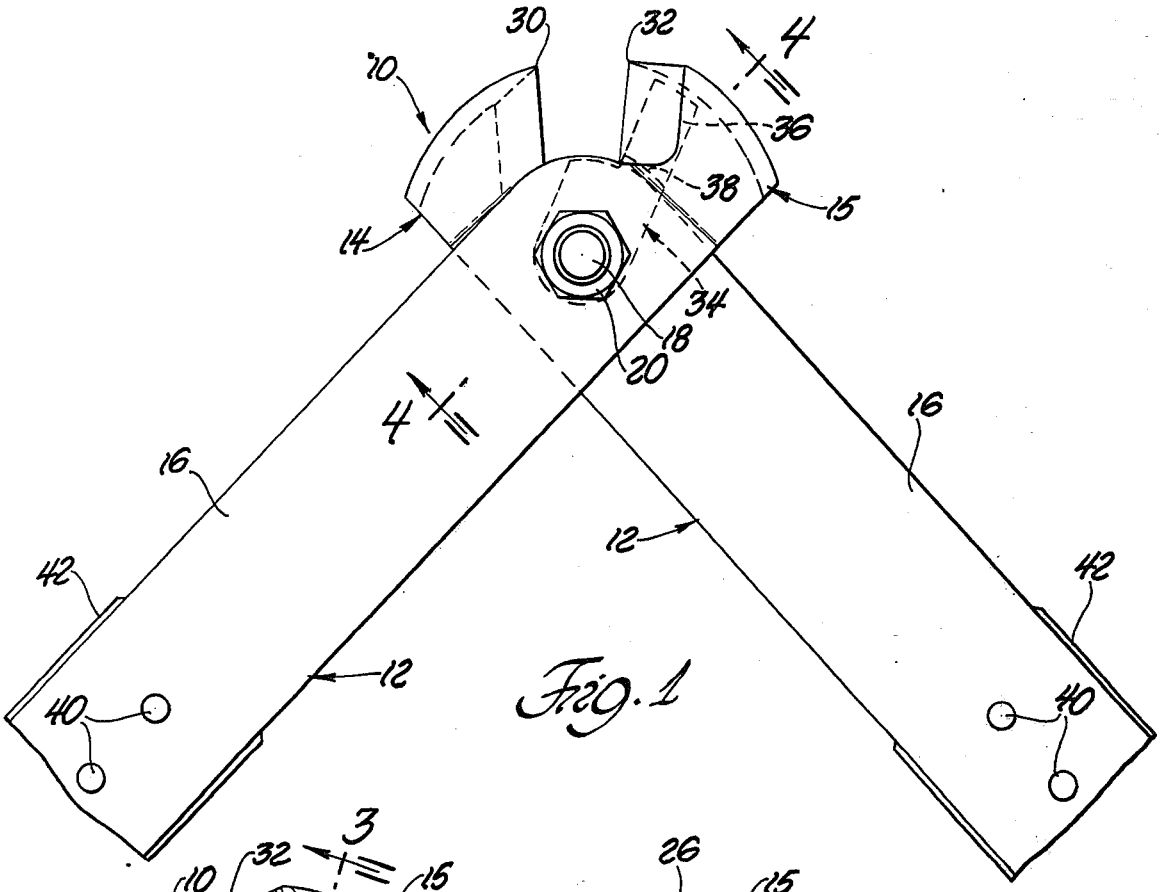
FIG. 1 is a fragmentary side elevational view of the instant invention showing the cutting jaws in an open position.

A cutting tool for cutting pieces from a solid member, such as a piece of wood, constructed in accordance with the instant invention, is generally shown at 10.

The cutting tool 10 includes a pair of pivotally connected handles generally indicated at 12. The handles 12 extend through and define a pair of coacting U-shaped cutting jaws generally indicated at 14 and 15. In the preferred embodiment of the instant invention, each of the handle members 12 is made from a single U-shaped metal strip. The arms 16 of each of the strips define the handle members 12 and the closed end portions of the strips define the cutting jaws 14 and 15. The strips are secured together at a pivot joint spaced from the cutting jaws 14 by a nut and bolt assembly 18 and 20, respectively, thereby defining a pivot shaft and axis. Therefore, one of the jaws is an inner jaw 14 disposed within the other jaw which is an outer jaw 15. In other words, during a cutting motion, the pivotally connected arms 16 are brought together to close the cutting jaws 14 and 15 such that the inside jaw 14 becomes disposed within the outer jaw 15.

Figure 3:
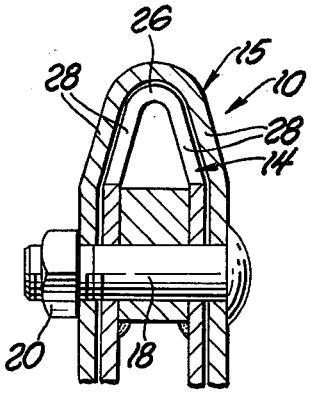
FIG. 3 is a view taken substantially along line 3—3 of FIG. 2.

As shown in FIG. 3, each of the cutting jaws 14 and 15 is U-shaped and consist of a base portion 26 and side legs 28. Each of the U-shaped jaws 14 and 15 define a cutting edge 30 and 32, respectively, extending throughout the base 26 and the side legs 28 of the U-shaped jaws 14 and 15.

Figure 2:
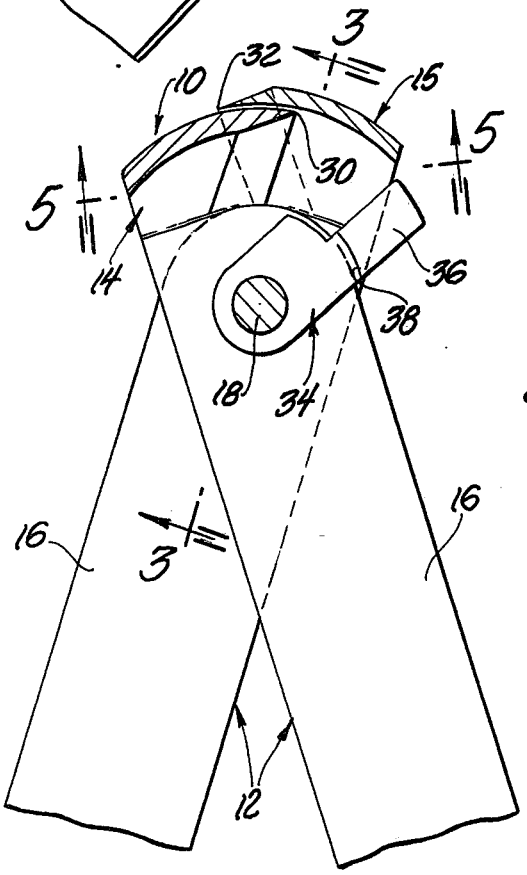
FIG. 2 is a similar view showing the cutting jaw in a closed position.
Figure 5:
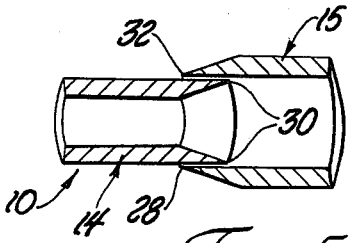
FIG. 5 is a view taken substantially along line 5—5 of FIG. 2.

As shown in FIGS. 1, 2, and 5, the cutting edges 30 and 32 are angulated in relation to each other so that the cutting edges 30 and 32 defined by the legs 28 of the respective jaws 14 and 15 are not in coacting relationship before the bases 26 of the U-shaped jaws 14 and 15. In other words, as the cutting jaws 14 and 15 are brought from the open position shown in FIG. 1 to the closed position shown in FIG. 2, the base 26 of the respective jaws 14 and 15 contact the surface of the member to be cut before the legs 28 of each of the respective cutting edges 30 and 32 thereby allowing the base portion 26 of the cutting edges 30 and 32 to contact and grasp the surface of the solid member prior to the remainder of the cutting edge entering the surface. The jaws 14 and 15 of the instant invention have a base 26 cutting edge which initially contacts and grasps the wood prior to the legs 28 of the U-shaped portion of the cutting jaws 14 and 15. This has been found to be very effective construction for chipping and cutting wood from a solid member. Alternatively, the cutting tool can be used for chipping and cutting away at solid members made of other materials. Therefore, the angulation of the cutting edges 30 and 32 of the cutting jaws 14 and 15, respectively, provide an effective cutting surface for removing chips or larger pieces of material from a solid member.

The specific construction of the cutting edges also provides a structural advantage for cutting pieces from a solid member. As shown in FIGS. 2 and 5, each of the jaws 14 and 15 have an inside and outside wall, the outside wall of the outer jaw 15 tapering inwardly to the inside wall to define the respective cutting edge 32 and the inside wall of the inner jaw 14 tapering outwardly to said outside wall thereof to define the respective cutting edge 30. Therefore, the cutting edges 30 and 32 of the inner 14 and outer 15 cutting jaws closely contact each other and are tapered away from the cutting edge in opposite directions. This structural relationship of the cutting edges 30 and 32 has been found to effectively cut wood chips.

Figure 4:
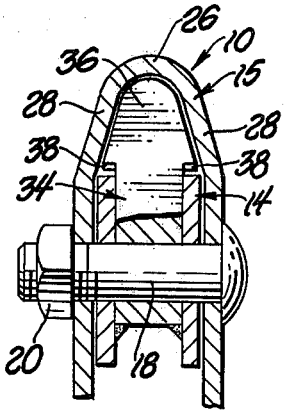
FIG. 4 is a view taken substantially along line 4—4 of FIG. 1.

The instant invention 10 further includes knock-out means, generally indicated at 34, disposed within one of the U-shaped jaws 14 or 15 for abutting material served by the jaws 14 and 15. The knock-out means 34 is supported on the pivot axis defined by the nut and bolt 18 and 20 that pivotally secures the arms 16 together. As shown in FIG. 4, the preferred embodiment of the instant invention includes the knock-out means 34 having a head portion 36 closely approximating the inside wall of the outer jaw 15. The head portion 36 includes shoulders 38 overlying the arms 16 extending from the legs 28 of the inner U-shaped jaw 14. In operation, as the cutting jaws 14 and 15 are brought into the closed position chipping a piece of material, the chip can become lodged within the outer U-shaped jaw 15. As the jaw is brought into the open position, as shown in FIG. 1, the head portion 36 of the knock-out means 34 abuts the material lodged within the outer jaw 15 thereby forcing it out from the outer jaw 15. The knock-out means may be welded or otherwise secured to the inside wall of the inside arms of the inside jaw. Alternatively, the shoulders 38 abut the arms of the inner jaw 14 thereby maintaining the knock-out means 34 in the desired position, as shown in FIG. 1.

The shape of the cutting jaws 14 and 15 provide another structural advantage. As shown in FIGS. 3 and 4, the base portions 26 of the U-shaped jaws 14 and 15 are narrower than the distance between the legs 28 extending therefrom. This shape provides additional strength for the cutting jaws which is necessary for the instant invention to be able to remove chips from hard material such as wood.

Each of the arms 16 extending from each of the respective jaws 14 and 15 are secured together by an appropriate fastening means 40, as shown in FIG. 1. The fastening means 40 may consist of nuts and bolts, or rivets, or any other appropriate fasteners for securing the arms 16 of the U-shaped strips together. A spacer member 42 is preferably disposed therebetween.

The combination of the above-mentioned structural features function together to provide an effective wood cutter. Unlike a conventional "scissor-type" cutter that forces an object away from the cutting edges as the scissor is closed, the base portions 6 of the cutting jaws 14 and 15 initially grip or clamp the piece of material between the jaws 14 and 15. As the jaws 14 and 15 are clamped together further, the leg portions 28 contact the material and the cutting edges 30 and 32 pull the material into the jaws 14 and 15, thereby effectively biting a piece off of the original material. Therefore, the instant invention includes structural features which allow the cutting jaws to grip the material and break off the gripped piece more effectively than prior art scissor-type cutters.

The instant invention has been described in an illustrative manner and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

The embodiments of the invention in which an exclusive property or privilege is claimed are defined as follows:

1. A cutting tool (10) comprising: a pair of handles (12) pivotally connected together for movement about a pivot axis, said handles (12) extending through and defining a pair of coacting U-shaped cutting jaws (14, 15), each of said U-shaped jaws (14, 15) defining a cutting edge (30, 32) extending throughout the bases (26) and the side legs (28) of said U shapes, said jaws (14, 15) having a closed position wherein one of said jaws (14) is an inner jaw disposed within the other of said jaws (15) which is an outer jaw, said cutting edges (30, 32) being angulated in relation to each other so that the cutting edges (30, 32) defined by said side legs (28) of the respective jaws (14, 15) are not in coacting relationship before said bases (26) of the corresponding U-shaped jaws (14, 15); and knock-out means (34) disposed within one of said U-shaped jaws (14, 15) for abutting material served by said jaws (14, 15), said knock-out means being supported on said pivot axis.

2. An assembly as set forth in claim 1 wherein each of said jaws (14, 15) have an inside and outside wall, said outside wall of said outer jaw (15) tapering inwardly to said inside wall to define said cutting edge (32) thereof and said inside wall of said inner jaw (14) tapering outwardly to said outside wall thereof to define said cutting edge (30) thereof.

3. An assembly as set forth in claim 2 wherein said knock-out means (34) includes a head portion (36) closely approximating the inside wall of said outer jaw (15).

4. An assembly as set forth in claim 3 wherein said handles (12) include an arm (16) integral with and extending from each of said legs (28) of said U-shaped jaws (14, 15).

5. An assembly as set forth in claim 4 wherein said head (36) of said knock-out means (34) includes shoulders (38) overlying said arms (16) extending from said legs (28) of said inner U-shaped jaw (14).

6. An assembly as set forth in claim 5 wherein said base portions (26) of said U-shaped jaws (14, 15) are narrower than the distances between said legs (28) extending therefrom.

7. An assembly as set forth in claim 6 wherein said arms (16) extending from each of said respective jaws (14, 15) are secured together and include a spacer member (42) secured therebetween.

8. An assembly as set forth in claim 7 including a pivot shaft (18) extending through said handles and said knock-out means to define said pivot axis.

* * * * *